US005676349A

United States Patent [19]

Wilson

[11] Patent Number: 5,676,349

[45] Date of Patent: Oct. 14, 1997

[54] WINCH WHEEL DEVICE WITH HALF CLEAT

[76] Inventor: Robert L. Wilson, 258 Goat Hill Rd., Lambertville, N.J. 08530

[21] Appl. No.: 638,796

[22] Filed: Apr. 29, 1996

Related U.S. Application Data

[63] Continuation-in-part of Ser. No. 351,814, Dec. 8, 1994, abandoned.

[51] Int. Cl.[6] ..... B66D 1/00

[52] U.S. Cl. ..... 254/266; 242/395; 74/557; 74/558

[58] Field of Search ..... 254/371, 344, 254/266; 242/395, 395.1; 74/557, 558; 114/268

[56] References Cited

U.S. PATENT DOCUMENTS

| | | | |
|---|---|---|---|
| 492,000 | 2/1893 | Fitzgibbon | 242/395 |
| 520,475 | 5/1894 | Barger | 242/395 |
| 1,149,029 | 8/1915 | Clark . | |
| 1,784,230 | 12/1930 | Freeman | 74/557 |
| 2,093,946 | 9/1937 | Wood . | |
| 2,162,173 | 7/1939 | Huntington, Jr. . | |
| 2,406,874 | 9/1946 | Walker . | |
| 2,468,314 | 4/1949 | Vogel | 74/557 |
| 2,713,274 | 7/1955 | Lockwood . | |
| 3,143,316 | 8/1964 | Shapiro . | |
| 3,529,786 | 9/1970 | Holden . | |
| 3,536,299 | 10/1970 | McCloud et al. . | |
| 3,599,937 | 8/1971 | Carter | 74/557 |
| 3,606,193 | 9/1971 | Allred . | |
| 4,022,398 | 5/1977 | Youngblood . | |
| 4,338,827 | 7/1982 | Hooker | 74/557 |
| 4,531,715 | 7/1985 | Weins . | |
| 4,627,374 | 12/1986 | Wright | 254/371 |
| 4,688,765 | 8/1987 | Guangorena | 254/371 |

*Primary Examiner*—Katerine Matecki
*Attorney, Agent, or Firm*—Michael de Angeli

[57] ABSTRACT

A winch wheel for attachment to conventional sailboat winches for trimming sails comprises a crank shaft adapted to be inserted into the winch mechanism, a hub located on the shaft, at least two spokes extending radially from the hub to an outer rim, and an outer rim connected to the spokes. A crank handle is located on one of the spokes. The rim is provided with a resilient foam sheath, to provide comfort and flotation. In one preferred embodiment, the crank handle is selectably movable between a plurality of discrete positions, permitting a user to conveniently select a preferred radial distance from the hub for the crank handle while using the device. One or more half cleats may be provided on the hub to secure a tensioned line.

19 Claims, 3 Drawing Sheets

2
11
13
9
17
45
10
32
29
19
12
18
20
4
13a
14
33
34
16
15

WINCH WHEEL DEVICE WITH HALF CLEAT

CROSS REFERENCE TO RELATED APPLICATION

This application is a continuation-in-part of U.S. patent application Ser. No. 08/351,814, filed on Dec. 8, 1994 by Robert L. Wilson, entitled "Winch Wheel Device", now abandoned.

BACKGROUND OF THE INVENTION

1. Field of the Invention

The present invention relates to a which wheel for the convenient operation of sail trimming winches on sailboats.

2. Information Disclosure Statement

Manually operable winches for sailboats have been around for many decades, and are commonly used to exert tension on ropes or lines, e.g., to raise or trim sails, hoist anchors, or for other purposes. As used on most pleasure craft, such winches typically include a capstan rotatable on a fixed base and controlled for one-way rotation by ratcheting pawls. A crew member exerts physical force on the capstan by way of a winch handle. Conventional winch handles include a central drive shaft fitting into a socket on the winch, a radially extending section, and a vertical gripping handle.

There are numerous limitations on conventional winch handles as means for exerting force on winch capstans. The force one can exert using a conventional winch handle is limited by the length of the radially extending section, which determines the mechanical advantage. It is often awkward to use both hands to operate the winch, limiting the power that can be exerted. Finally, most winches of older design, i.e., so-called non self-tailing winches do not provide means for securing the line after winching to a desired tension, requiring that a separate cleat be provided.

The following patents are representative of various cranking devices for winding chains, ropes, and fences and related mechanisms:

- U.S. Pat. No. 492,000 to Fitzgibbon discloses a device for reeling and stretching wire having a wheel for rotating a shaft.
- U.S. Pat. No. 520,475 to Barger describes and illustrates a machine for stretching and removing fence wire having a wheel attached to a shaft.
- U.S. Pat. No. 1,149,029 to Clark discloses a crank wheel, e.g., for drilling blast holes in mines. The Clark wheel includes a spoke having a radial groove, a bar having a gripping handle adjustably movable along the radial groove, and a spring-loaded pawl fitting within serrations to secure the bar in a desired position.
- U.S. Pat. No. 1,784,230 to Freeman relates to a hand grip attachment for steering wheels of automobiles. Freeman shows a grippable knob rotatable with respect to a base which can be clamped at a desired radial position on a spoke of the steering wheel.
- U.S. Pat. No. 2,093,946 to Wood describes a hand crank chain block which includes a flip-up hand crank.
- U.S. Pat. No. 2,162,173 to Huntington, Jr. describes an adjustable crank structure for fishing reels and other applications. The Huntington adjustable crank has an off-centered block attached to a central reel. A crank arm may be slid inwardly and outwardly to achieve adjustable length.

- U.S. Pat. No. 2,468,314 to Vogel describes and illustrates a steering system for a vehicle wherein a lever is connected to the steering post through a sun-and-planet gear train, whereby increased torque may be imparted to the steering post by the operator when desired.
- U.S. Pat. No. 2,713,274 to Lockwood describes a fishing reel drive including a series of gears for transmitting torque from a crank handle to the main shaft of the reel.
- U.S. Pat. No. 2,401,874 to Walker shows a control element for model airplanes having an adjustable crank handle.
- U.S. Pat. No. 3,143,316 to Shapiro describes a kite reel device having adjustable crank handles on either side of the reel. The crank handles are pulled axially outwardly against a spring bias to adjust their radial position.
- U.S. Pat. No. 3,529,786 to Holden describes a cord storage reel which has a set of swing-out handles which has a first position and a second position for rolling or winding.
- U.S. Pat. No. 3,536,299 to McCloud et al describes a winch mechanism which includes a crank arm and crank handles. The crank arm is hingedly attached to the winch hub at its central axis so that the crank arm and handle can be rotated upwardly and then dropped into the center of the winch.
- U.S. Pat. No. 3,599,937 to Carter discloses a multiple speed winch having a plurality of independently rotatable pinions coaxial with a drive shaft, drive linkages of varying mechanical advantage connecting the pinions to the winch drum, and a shaft engager for engaging a selected pinion to the drive shaft.
- U.S. Pat. No. 3,606,193 to Allred describes a crank for a fishing reel with an adjustable crank arm. A screwdriver is required to adjust the position of the crank arm.
- U.S. Pat. No. 4,022,398 to Youngblood describes a hose reel for winding elongated members such as a garden hose, electrical cord, or rope onto a hollow cylinder having a central bore and a slotted cylinder wall to form a passage for retaining a first end of the elongated member. Handles are rotatably secured eccentrically from the central axis of the reel such that the reel may be rotated.
- U.S. Pat. No. 4,338,827 to Hooker teaches a marine winch handle having a hollow arm and crank so as to float.
- U.S. Pat. No. 4,531,715 to Wiens describes a winch with a storable handle. The crank arm and the crank handle are hingedly attached so as to be positioned at right angles to one another or in straight alignment. Additionally, the crank handle may be swung upwardly and dropped into the central shaft of the winch. When aligned with the crank arm, the handle may be pushed inwardly over the crank arm.
- U.S. Pat. No. 4,627,374 to Wright discloses accessories for yachts, such as work-holding vices, adapted to be secured to the socket provided as part of a yacht winch to receive the winch handle.
- U.S. Pat. No. 4,688,765 to Guangorena discloses a winch drum having recesses spaced around the surface of the capstan to improve the gripping action.

SUMMARY OF THE INVENTION

The present invention is of a winch wheel replacing the winch handles conventionally used to exert torque on winches, e.g., for trimming sails on sailboats.

The winch wheel of the invention includes a drive shaft adapted to be inserted into a socket of a conventional sailboat winch, a hub located on the shaft, at least two spokes extending radially from the hub to a circular outer rim, and at least one half cleat for cleating off a line of rope. A crank handle may also be provided. Preferably the rim is covered in a low-density foam material, providing comfort in use and flotation.

In one preferred embodiment, the winch wheel of the invention further includes an adjustment mechanism located on one of the spokes and providing a plurality of discrete positions for the crank handle, so as to permit a user to select a desired radial distance of the crank handle from the hub. The crank handle can be moved radially to alter its mechanical advantage as the cranking motion is in progress.

BRIEF DESCRIPTION OF THE DRAWINGS

The present invention will be more fully understood when the present specification is taken in conjunction with the drawings appended hereto, wherein.

DETAILED DESCRIPTION OF THE PRESENT INVENTION

Figure 1:
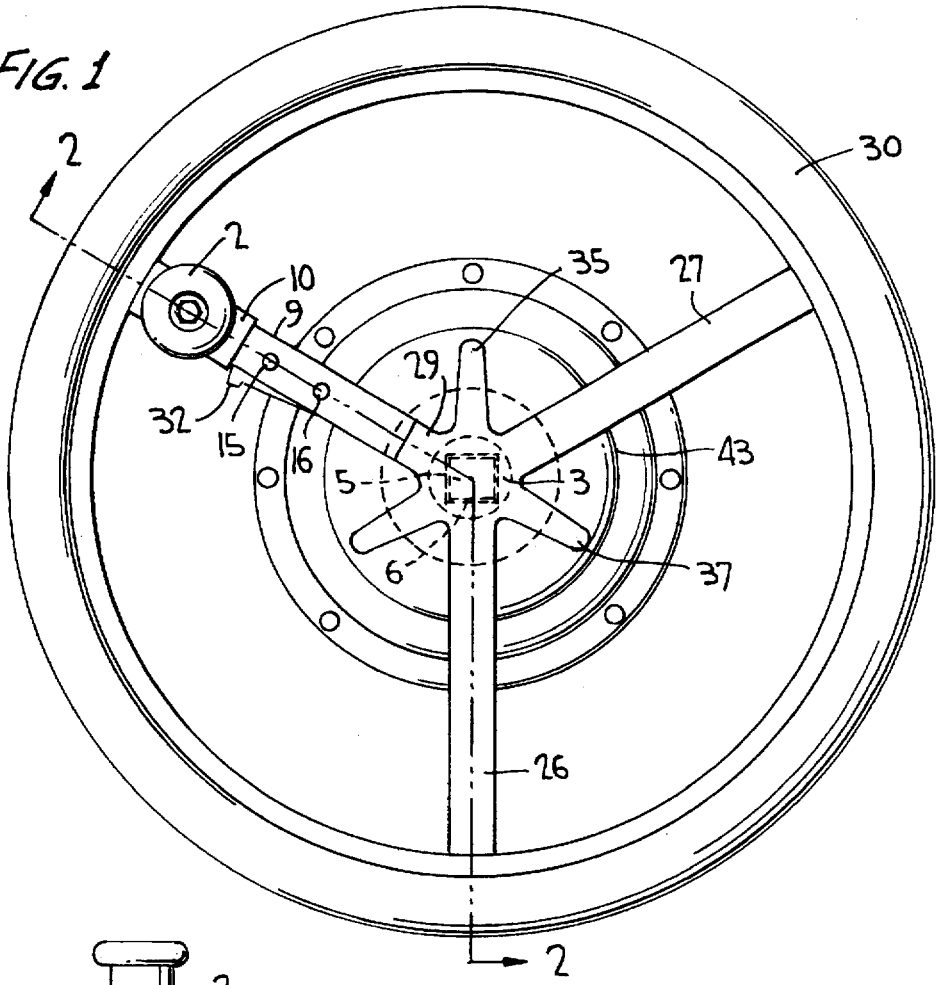
FIG. 1 shows a top view of one embodiment of the winch wheel of the present invention, including two half cleats.

Manually operable winches including a rotatable capstan driven by operator effort applied to a crank arm are used for obtaining a mechanical advantage in a variety of applications on sailboats, e.g., in the hoisting or trimming of sails, especially the foresails, or jibs. However, as previously mentioned, the length of the winch handle conventionally employed controls the mechanical advantage provided, and forces the user to compromise. A short crank arm allows one to rotate the winch capstan quickly, but will yield poor mechanical advantage when a strong wind fills the sail. A long crank handle will give higher mechanical advantage, but is slow to take up the slack in the line.

The most common use of winches on sailboats is in trimming the foresails. Each time the boat is tacked, the line then controlling the foresail, typically the original leeward jib sheet, must be cast off from a winch on one side of the boat, and a second sheet on the other side of the boat must be secured to a winch on that side and significant tension exerted. As conventionally practiced, a winch handle, simply comprising a grippable handle at one end of a fixed-length lever and a drive shaft on the other, is inserted into the winch on the new leeward side of the boat. Cranking force is then exerted by a crew member to apply tension to the new working sheet. When, as is usual, the boat heels to the leeward side, the crew member often has to kneel awkwardly over the winch, forcing one hand to be used to maintain balance, and allowing only one hand to be used for cranking the winch.

Winch handles are now being sold with enlarged gripping portions so as to enable both hands to be used at once; however, one then lacks a free hand for maintaining one's balance. As the wind speed increases, the heeling and motion of the boat increase similarly, so that just when one needs more strength available to winch in the sheet, one has a greater need to use one hand to preserve one's balance.

Similarly, during the first portion of the trimming step, sheet tension is low, so that it would be desirable to winch in the sheet rapidly. As the sheet is winched in, the tension increases, so it would be desirable to have a greater mechanical advantage. Multiple speed winches are available to address this need, but are relatively costly.

The winch wheel of the present invention is intended to assist a sailor in transforming his or her muscle power into torque applied to a winch as typically used on modern sailboats for sail hoisting or trimming.

The winch wheel comprises a hub, a number of spokes, and a circular rim. The hub includes a drive shaft fitting into the torque-receiving socket of a conventional sailboat winch. The rim comprises a core and a sheath of a low-density foam covering the core, providing flotation and a comfortable grip for the user.

The continuous circular rim of the winch wheel of the invention can be gripped on opposite sides of the hub by a crew member's two hands. As one hand is "pulling" while the other is "pushing", one's balance is conveniently maintained, while significant additional force can be exerted. Advantages of efficiency, comfort, and safety are simultaneously realized.

In one embodiment, a crank handle is attached to a slide sliding on a track mounted on one of the spokes. The position of the slide can be adjusted in toward the hub or out toward the rim, thus allowing the mechanical advantage to be selected as desired, while the cranking motion is in progress. The crank handle rotates on a spring-loaded pin extending through the slide and into one of two or more position holes drilled in the track defining a number of discrete radial positions for the crank handle. Selection of a position close to the center hub gives the crank handle a short radius for high speed turning of the winch capstan, while positions closer to the rim will give the crank handle a longer radius for a more powerful mechanical advantage.

At least one and preferably several half cleats extend from the hub, for cleating off and maintaining desired tension on a line.

Figure 2:
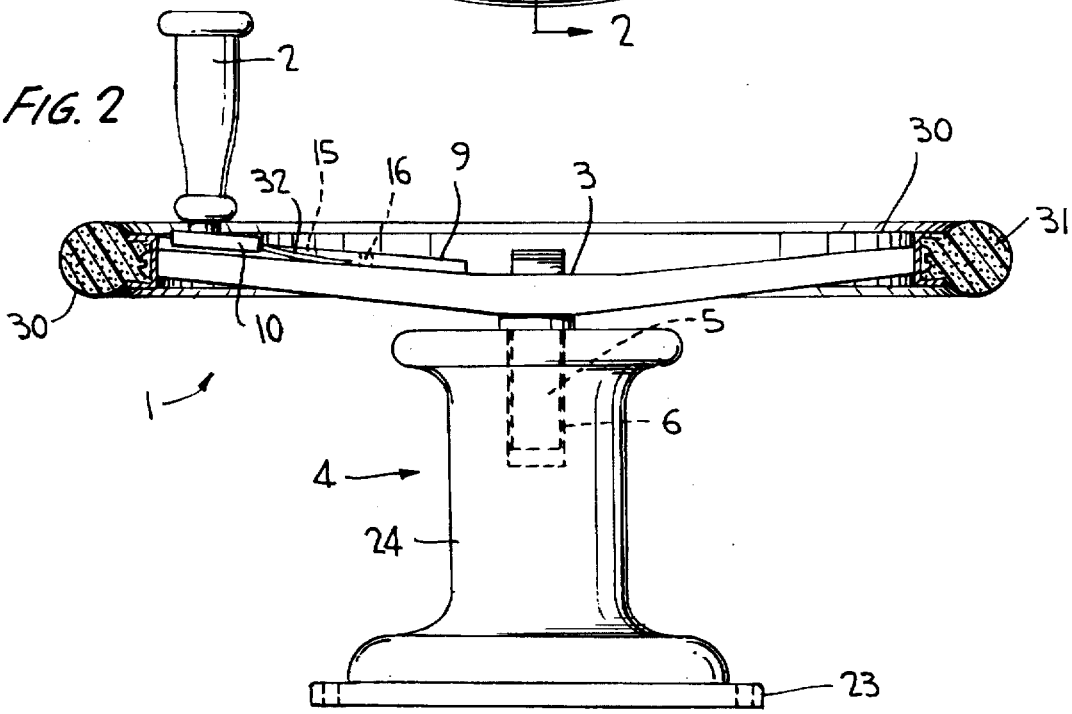
FIG. 2 shows a side, partially cross-sectional view of the winch wheel, as mounted to a conventional sailboat winch.

Referring to FIGS. 1 and 2, a conventional winch 4 has a socket 6 to receive a drive shaft of a conventional winch handle. Winch 4 includes a fixed base 23 for mounting to a sailboat, and a capstan 24 rotatably mounted to the base 23. Depending on the design of winch 4, rotation of socket 6 in either or both directions may drive capstan 24. Capstan 24 rotates clockwise (when viewed from above) to winch in a line wrapped therearound, with counterclockwise motion being prevented by spring-loaded pawls or the like.

Winch 4 includes internal gearing to transfer torque from socket 6 to capstan 24, allowing a tensioned line to be wound thereon by exertion of force rotating wheel 1. Winches of this type are well known as exemplified by the prior art cited above, e.g., by U.S. Pat. No. 3,599,038 to Carter. Elaboration here is, therefore, unnecessary. Rather, the present invention involves a substitute device which replaces conventional winch handles.

The winch wheel 1 of the present invention includes a drive shaft 5 which is inserted into socket 6. Drive shaft 5 and socket 6 have mating cross-sections, allowing torque to be transferred from the winch wheel 1 to the winch 4.

Hub 3 is fixed to drive shaft 5. At least two spokes extend outwardly from hub 3 and terminate at a continuous circular outer rim 30. Three spokes 26, 27, and 29 are shown. A handle 2 is mounted to spoke 29 in the embodiment shown. Handle 2 is journaled for rotation about a pin 11, as discussed below with respect to FIG. 3. Pin 11 is secured to slide 10, which is selectably movable along a T-track 9 between a plurality of discrete positions. In FIG. 2, handle 2 is shown in an outer location, useful to obtain maximum mechanical advantage. Thus, a user may locate the handle 2 at any one of several locations to achieve a desired combination of mechanical advantage and speed. The user may also grip outer rim 30 with both hands, as noted above, for exerting force on the wheel at opposite sides.

Extending beyond the hub 3 are one or more fingers or half cleats 35, 37 for cleating off a line of rope. as discussed with respect to FIGS. 5 and 6 below.

Preferably, flotation wrap 31, e.g., closed-cell polyurethane foam or the like, substantially surrounds rim 30 of wheel 4, as illustrated in FIG. 2. This provides comfort in use, protects the vessel if the winch wheel is dropped, and provides flotation allowing the winch wheel to be retrieved if it falls in the water.

Figures 3, 4:
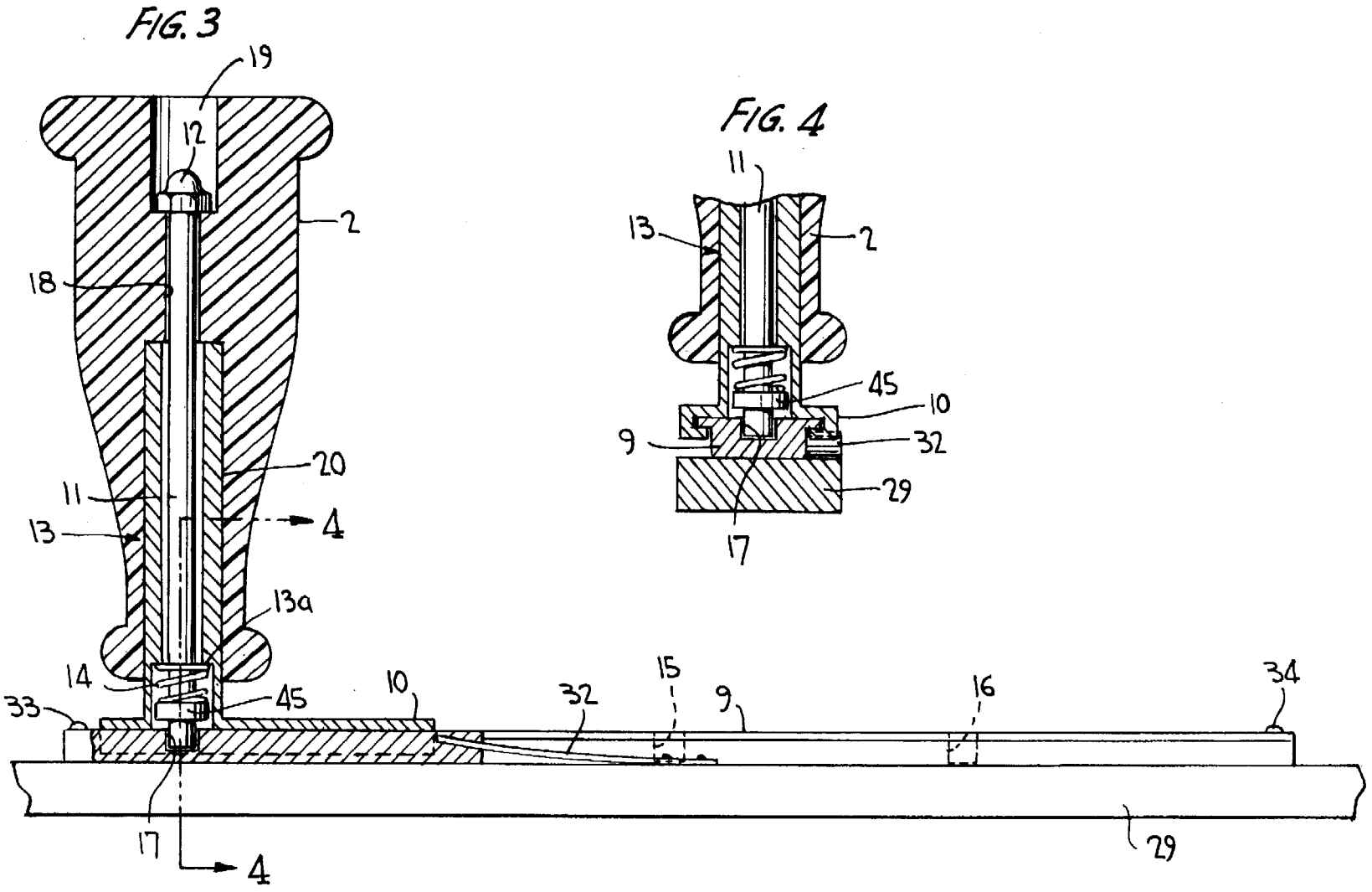
FIG. 3 illustrates an enlarged, partially cross-sectional view of a portion of the winch wheel of the present invention.
FIG. 4 is a partial cross-section taken along line 4—4 in FIG. 3.

As shown in FIGS. 3 and 4, handle 2 has a central bore including narrow diameter portion 18 and wider portions 19 and 20. Pin 11 extends through all three portions 18, 19, and 20. A nut 12 on pin 11 captures handle 2 on pin 11. Bushing 13 fits within passage 20 and is secured to slide 10. Handle 2 rotates with respect to bushing 13. A spring 14 is confined around the bottom end of pin 11, between a shoulder **13*a* formed in sleeve 13, and a collar 45 on pin 11. Accordingly, pin 11 is urged downward by spring 14, so that the lower end of pin 11 is retained in a selected one of bores 15, 16, 17 in a T-track 9 (see FIG. 4) secured to spoke 29. In its normal position shown, pin 11 thus prevents sliding of handle 2 and slide 10 along spoke 29. However, if a user lifts handle 2 upwardly, lifting pin 11 out of bore 17, handle 2 and slide 10 may then be moved along T-track 9 toward hub 3 or rim 30, as desired. When handle 2 is then released, spring 14 will urge pin 11 downwardly to drop pin 11 into orifice 15 or 16, as desired. When so located, handle 2 can be lifted again and moved radially inwardly or outwardly as desired. Note that T-track 9 is secured to arm 29 by screws 33 and 34, which also act as end stops. However, T-track 9 could be otherwise attached, or could be integrally formed with spoke 29**.

Optional lock 32, here a leaf spring attached to spoke 29, will snap up to abut an edge of slide 10 when slide 10 is moved outwardly, preventing movement of slide 10 from outer to inner positions, unless pressed. Other lock mechanisms may be substituted without exceeding the scope of the present invention.

For example, the pin, spring, and handle could be arranged so that the handle could be pressed downwards instead of pulled upward to release the pin for slide activation. Alternatively, a ratcheting mechanism could be used, or a geared arrangement, e.g., rack and pinion gearing, to permit movement of the slide radially inwardly and outwardly between selected locked positions.

The particular functional advantage of the lock mechanism shown is that the handle 2 can be brought radially outwardly during cranking. This is particularly advantageous in trimming jib sheets after tacking. Initially, when the sheet loading is low, the handle is disposed in an inner position, for high speed winching of the line on the capstan. As the sail is trimmed, and the tension on the line increases, the handle can be moved outwardly to increase its mechanical advantage, without ceasing cranking, by momentarily lifting it upwardly. Provision of the spring lock 32 ensures that both hands must be used to move the handle inwardly, i.e., in preparation for a tack, preventing inadvertent motion inward.

Figure 5:
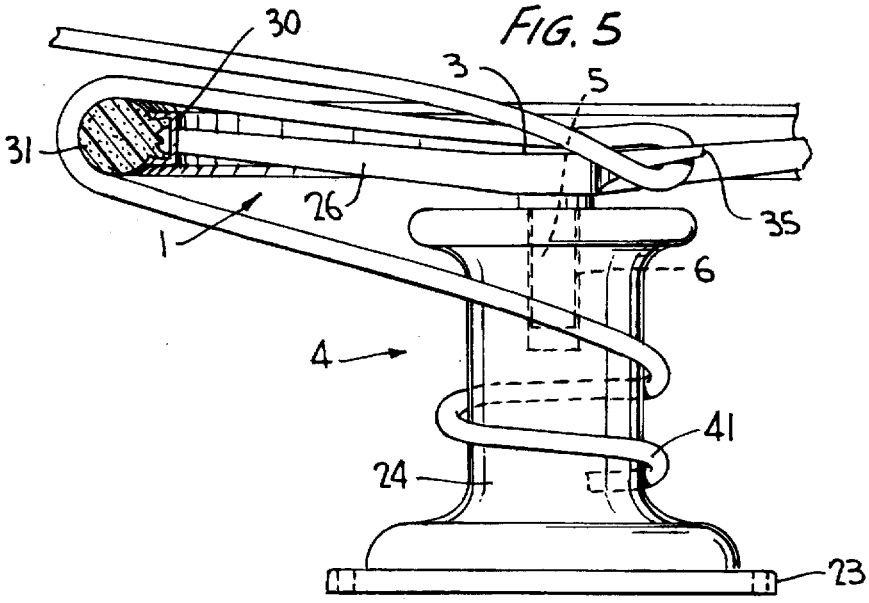
FIG. 5 shows a side, partially cross-sectional view of the winch wheel, as mounted to a winch, and having a line secured thereto.
Figure 6:
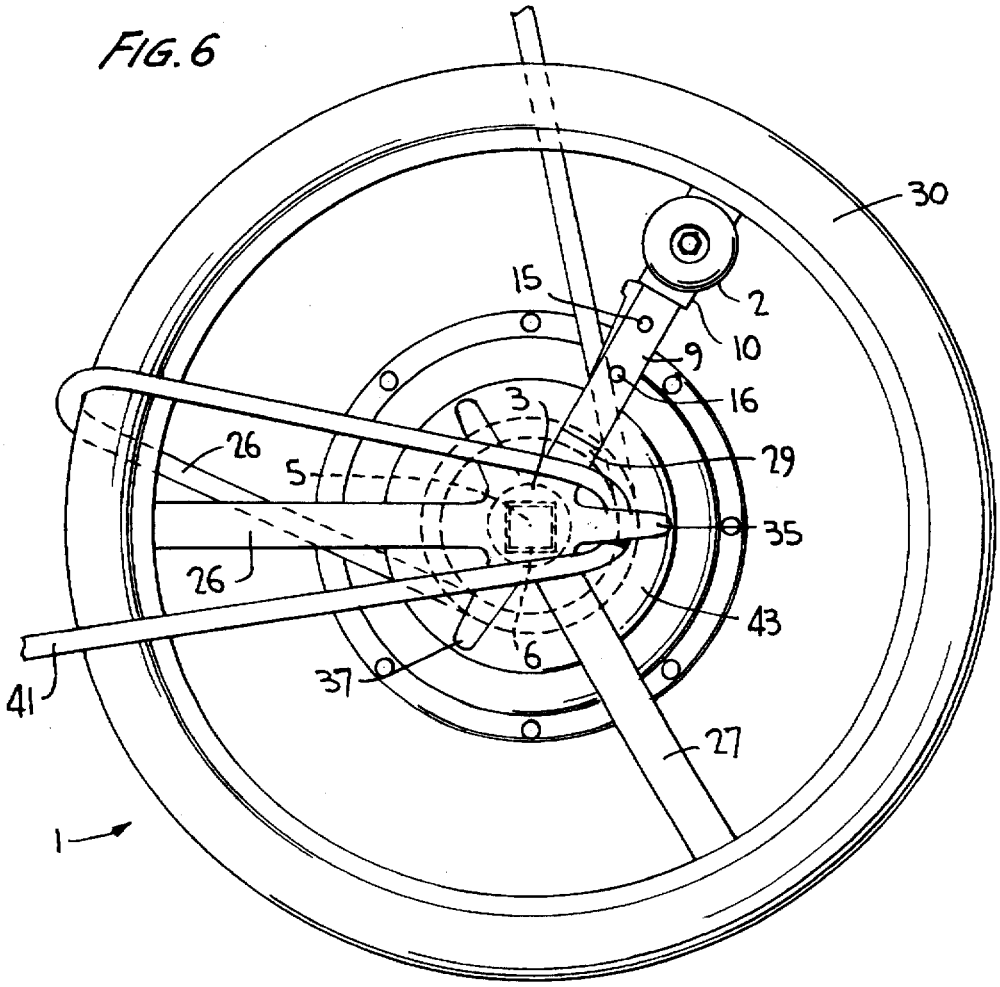
FIG. 6 shows a plan view thereof.

FIGS. 5 and 6 shows views corresponding to FIGS. 2 and 1 respectively, but with the addition of a line 41, that is, showing a section of rope as used on a sailboat, and showing the manner in which half cleats 35 and 37 may be used to secure the line to the winch wheel, maintaining desired tension thereon.

More specifically, it will be recognized by those of skill in the art that although so-called "self-tailing" winches have recently become common, sailboat winches historically have been "non self-tailing". "Tailing" in this circumstance refers to maintaining tension on the free end of a line wrapped several times around the capstan of a winch, to provide friction between the capstan and line sufficient that rotation of the capstan draws the line in under tension. With a non self-tailing winch, it is customary for a first crew member to maintain tension on the line, the line having been wrapped several times around the capstan, while a second crew member applies torque to the winch by a winch handle, so as to rotate the capstan. More modern self-tailing winches include "grippers" or "jaws" rotating with the capstan for applying tension to the line exiting the capstan, so that only a single crew member is required to crank the winch. Such a "self-tailing" winch is capable of maintaining tension on the line after cranking is complete.

If a non self-tailing winch is used, the free end of the line must be cleated to a cleat provided in the vicinity of the winch to maintain the tension thereon. The winch wheel of the present invention is provided in a preferred embodiment with several half cleats 35, 37. As shown, line 41 may be cleated to one of the half cleats 35, 37 after it has been cranked to the desired tension, thus obviating the need to cleat the line to a separate cleat disposed in the vicinity of the winch.

Thus, a line 41 to which tension is to be applied is wrapped around the capstan 24 of the winch; while three or more wraps typically are provided, only one is shown, for clarity. The line is then "tailed" by a crew member, that is, tension is applied to the free end of the line, so that when a second crew member cranks the winch, sufficient friction exists between the capstan and the line that the line is wound upon the capstan against tension provided by a sail or the like. According to this aspect of the present invention, when the line has been tensioned to the desired degree, it may be brought up around the resilient cover 31 provided around the periphery of the rim of the winch wheel, and simply passed around one of the cleats 35 or 37, as shown, thus maintaining tension thereon. The advantage is that a separate cleat need not be provided. Moreover, the resilient cover 31 provided over the rim 30 provides sufficient friction between the rim and the line that a simple half twist of the line around one of the half cleats 35 or 37, as shown, is sufficient to maintain tension on the line.

Obviously, numerous modifications and variations of the present invention are possible in light of the above teachings. It is therefore understood that within the scope of the appended claims, the invention may be practiced otherwise than as specifically described herein.

I claim:

1. A winch wheel for rotatively driving a sailboat winch used for trimming sails on a sailboat, said sailboat winch including a driven shaft having a socket at one end, and a capstan driven by said driven shaft, said winch wheel comprising:

a drive shaft having a cross-section which conforms to the shape of said socket in said driven shaft to fit within the socket and transmit torque to said driven shaft, a hub fixed to said drive shaft, a continuous circular rim, and a plurality of spokes extending radially from said hub to said rim.

2. The winch wheel of claim 1, wherein said winch wheel is constructed so as to be of sufficiently low density to float.

3. The winch wheel of claim 2, wherein said rim comprises a core and a sheath substantially covering said core, said sheath comprising a low density resilient foam material providing sufficient flotation that said winch wheel floats.

4. The winch wheel of claim 1, further comprising a grippable handle extending from one of said spokes and mounted for rotation about an axis generally perpendicular to the plane of said spokes.

5. The winch wheel of claim 4, wherein said grippable handle is mounted to a member movable between a number of discrete positions along said one of said spokes.

6. The winch wheel of claim 5, wherein the outermost of said discrete positions with respect to said hub is inward of said rim.

7. The winch wheel of claim 5, wherein said member movable between a number of discrete positions along said one of said spokes is a slider retained on a track mounted to said one of said spokes, said track having a cross-sectional shape corresponding to the cross-sectional shape of said slider.

8. The winch wheel of claim 7, wherein said discrete positions along said one of said spokes are defined by bores therein, and the position of said handle along said spoke is selectively fixed by disposition of a spring-biased pin into one of said bores.

9. The winch wheel of claim 8, further comprising a leaf spring biased to secure said slider in an outward position on said spoke, such that said slider can be moved inwardly along said spoke from said outward position only by moving said leaf spring against said bias and out of engagement with said slider.

10. The winch wheel of claim 4, wherein said grippable handle is journaled for rotation about said spring-biased pin.

11. The winch wheel of claim 1, further comprising one or more cleats fixed to said hub.

12. A winch wheel for rotatively driving a sailboat winch used for trimming sails on a sailboat, said sailboat winch including a driven shaft having a socket at one end, and a capstan driven by said driven shaft, said winch wheel comprising:

a drive shaft having a cross-section which conforms to the shape of the socket in said driven shaft to fit within said socket and transmit torque to said driven shaft, a hub fixed to said drive shaft, a continuous circular rim, and a plurality of spokes extending radially from said hub to said rim, said rim comprising a circular metallic member fixed to said spokes and a sheath extending circumferentially around and substantially covering said circular metallic member, said sheath comprising a low density resilient foam material providing a comfortable gripping surface for a user and sufficient flotation that said winch wheel floats.

13. The winch wheel of claim 12, further comprising a grippable handle extending from one of said spokes and mounted for rotation about an axis generally perpendicular to the plane of said spokes.

14. The winch wheel of claim 13, wherein said grippable handle is mounted to a member movable between a number of discrete positions along said one of said spokes.

15. The winch wheel of claim 14, wherein the outermost of said discrete positions with respect to said hub is inward of said rim.

16. The winch wheel of claim 15, wherein said member movable between a number of discrete positions along said one of said spokes is a slider retained on a track mounted to said one of said spokes, said track having a cross-sectional shape corresponding to the cross-sectional shape of said slider.

17. The winch wheel of claim 16, further comprising a leaf spring biased to secure said slider in an outward position on said spoke, such that said slider can be moved inwardly along said spoke from said outward position only by moving said leaf spring against said bias and out of engagement with said slider.

18. The winch wheel of claim 15, wherein said discrete positions along said one of said spokes are defined by bores therein, and the position of said handle along said spoke is selectively fixed by disposition of a spring-biased pin into one of said bores.

19. The winch wheel of claim 18, wherein said grippable handle is journaled for rotation about said spring-biased pin.

* * * * *